United States Patent [19]

Obara et al.

[11] Patent Number: 5,013,466

[45] Date of Patent: May 7, 1991

[54] LUBRICATING GREASE

[75] Inventors: Kenjiro Obara; Kazuyuki Nakamura; Yoshio Murakami, all of Ibaraki; Takao Soda, Hyogo; Toshihiro Kanie, Hyogo; Tamio Adaka, Hyogo, all of Japan

[73] Assignees: Japan Atomic Energy Research Institute, Tokyo; Natsumra Oil Research Corporation, Nishinomiya, both of Japan

[21] Appl. No.: 496,700

[22] Filed: Mar. 21, 1990

[30] Foreign Application Priority Data

Mar. 23, 1989 [JP] Japan ..... 1-71473

[51] Int. Cl.[5] ..... C10M 105/08

[52] U.S. Cl. ..... 252/42.7

[58] Field of Search ..... 252/42.7, 25, 27, 28, 252/31, 56 S

[56] References Cited

U.S. PATENT DOCUMENTS

| | | | |
|---|---|---|---|
| 3,763,244 | 2/1973 | Shubkin | 256/56 S |
| 3,843,529 | 10/1974 | Bertrand | 252/30 |
| 3,944,594 | 3/1976 | Kleiner et al. | 252/407 |
| 4,094,855 | 3/1978 | Spivack | 558/198 |
| 4,715,972 | 12/1987 | Pacholke | 252/30 |
| 4,749,502 | 6/1988 | Alexander et al. | 256/56 S |

*Primary Examiner*—Margaret B. Medley

*Attorney, Agent, or Firm*—Banner, Birch, McKie & Beckett

[57] ABSTRACT

A lubricating grease exhibits good lubricating performance in a hot and high-vacuum environment, and contains an alkyl substituted tetraphenylether as a base oil having incorporated therein bentonite as a thickener and at least one solid lubricant selected from the group consisting of molybdenum disulfide and tungsten disulfide.

1 Claim, No Drawings

LUBRICATING GREASE

BACKGROUND OF THE INVENTION

The present invention relates to a grease that exhibits good lubricating performance in a hot and high-vacuum environment. More particularly, the present invention relates to a lubricating grease that contains an alkyl substituted tetraphenylether as a base oil having incorporated therein bentonite as a thickener and at least one solid lubricant selected from the group consisting of molybdenum disulfide and tungsten disulfide.

The drive mechanism of machines that are to be used in a hot and high-vacuum atmosphere is composed of many mechanical elements such as gear wheels and bearings, and the use of lubricants is essential for smooth operation of these elements. To this end, solid lubricants typified by molybdenum disulfide are coated on the surface of metal parts to be used in a hot and high-vacuum atmosphere. In some cases, such solid lubricants are combined with soap-based greases containing petroleum lubes as base oils.

The use of solid lubricants alone has the problem that the lubricating film has a relatively weak adhesion to the substrate and is prone to separation in applications where high stresses are to be exerted. The combination of solid lubricants with soap-based greases that contain petroleum lubes as base oils has its own problems such as evaporation loss and deterioration loss, which result in the fouling of the interior of the machine in which the lubricant is used.

In order to solve the aforementioned problems, it is important that the lubricant to be used insure prolonged and consistent lubrication in a hot and high-vacuum atmosphere without experiencing any evaporation loss and deterioration loss, which would otherwise foul the interior of the machine in which the lubricant is used.

SUMMARY OF THE INVENTION

It is an object of the present invention to provide a lubricant that satisfies these requirements and that exhibits good lubricating performance in a hot and high-vacuum atmosphere.

The base oil of a grease affects chiefly the heat resistance and operating characteristics in vacuum whereas the thickener and solid lubricant components affect the lubricating performance, so in order to enhance the lubricating performance of the grease, the characteristics of these components must be improved. It is also important that the gel structure which is characteristic of the grease composed of the base oil, thickener and solid lubricant remain stable in a hot and high-vacuum environment.

Considering these factors, the present inventors first prepared a grease composed of an alkyl substituted tetraphenylether, a bentonite based thickener and molybdenum disulfide and examined how much it would wear at 100° C. or 150° C. As a result, it was found that this grease wore by much smaller amounts than conventional greases based on mineral oils and that it remained stable after the wear test.

In the next place, the present inventors investigated the load-bearing ability of the grease on a block-on-ring tester in accordance with ASTM D 2714 and 3704 at a rotational speed of 100 rpm and at a temperature of 150° C. and a pressure of 0.01 Torr. As a result, it was found that the grease had better lubricating performance than grease based on mineral oils irrespective of whether they were used alone or used in combination with solid lubricants. Further, the grease was subjected to an endurance test at a rotational speed of 100 rpm, a temperature of 150° C. and a pressure of 0.01 Torr under a load of 500 pounds. It was found that the useful life of this grease was about twice as long as the life of the molybdenum conventionally coated on metal surfaces.

The present inventors also found that when the alkyl substituted tetraphenylether had 1–4 substituents, at least one of which contained 6–20 carbon atoms, the grease samples behaved in a similar way and exhibited excellent lubricating performance in a hot and high-vacuum atmosphere.

Thus, the present invention is based on the finding that when the alkyl substituted tetraphenylether described above was used as a base oil which was combined with a bentonite-based thickener and a solid lubricant, a grease having good heat and oxidation resisting properties, high operating characteristics in vacuum and satisfactory lubricating performance could be obtained and that this grease performed effectively in lubricating machines to be used in high vacuum and at high temperatures.

Therefore, the general object of the present invention is to provide a lubricating grease that contains an alkyl substituted tetraphenylether as a base oil having incorporated therein a bentonite based thickener and a solid lubricant selected from the group consisting of molybdenum disulfide and tungsten disulfide, and that exhibits high lubricating performance in a hot and high-vacuum atmosphere.

Stated more specifically, the lubricating grease of the present invention comprises the following ingredients:

(A) 55 wt % to 90 wt % of a base oil composed of an alkyl substituted tetraphenylether having 1–4 substituents at least one of which has 6–20 carbon atoms;

(B) 5 wt % to 25 wt % of a bentonite-based thickener; and (C) 5 wt % to 20 wt % of at least one lubricant that is selected from the group consisting of molybdenum disulfide and tungsten disulfide and that has a particle size of 0.1 μm to 20 μm.

DESCRIPTION OF THE PREFERRED EMBODIMENTS

The lubricating grease of the present invention described above contains the base oil in an amount ranging from 55 to 90 wt %, preferably from 65 to 75 wt %, of the product grease.

For preventing evaporation and deterioration, it is generally preferred that the base oil contains up to 5 wt % of an antioxidant which may be selected from among any phenolic, amine, phosphorus and sulfur containing compounds as long as it dissolves in the base oil and will remain stable for a prolonged period without deterioration under ordinary conditions of storage. Preferred antioxidants are phenolic and sulfur-containing compounds. Examples of useful phenolic antioxidants are octadecyl-3-(3,5-di-t-butyl-4-hydroxyphenyl)propionate, 2,2'-methylenebis(4-ethyl-6-t-butylphenol), and 1,3,5-trimethyl-2,4,6-tris(3,5-di-t-butyl-4-hydroxybenzyl)benzene. Examples of useful sulfur-containing antioxidants are dilauryl thiodipropionate, distearyl thiodipropionate and 2,2'-thiodiethylbis[3-(3,5-di-t-butyl-4-hydroxyphenyl)propionate].

The present inventors found that when a bentonite based thickener was incorporated in the alkyl substituted tetraphenylether optionally containing an antioxidant, a grease was obtained that formed a stable gel structure in a hot and high-vacuum atmosphere, that had a proper level of consistency and that exhibited high lubricating performance. In this case, the bentonite-based thickener is incorporated in an amount of 5–25 wt %, preferably from 10 to 17 wt %, of the product grease. Commonly used bentonite-based thickeners require the addition of a small amount of a gelling aid in order to form a stable gel structure. In the present invention, however, a bentonite-based thickener that does not require a volatile gelling aid is used and it was found that this contributed to improvements in operating characteristics in vacuum and lubricating performance. Illustrative bentonite-based thickeners that do not require a gelling aid and that may be used in the present invention are Bentone (trademark) SD-1, SD-2, and Baragel (trademark) 300, all being available from NL Industries.

The solid lubricant used in the present invention is a component that greatly affects the lubricating performance, which is the most important aspect of lubricating greases, and it is a fine powder that is selected from the group consisting of molybdenum disulfide and tungsten disulfide and has a particle size of 0.1–20 μm. Examples of molybdenum disulfide that can be used include Molykote (trademark) Microsize Powder and Z Powder (all being products of Dow Corning Corporation), as well as Molysulfide (trademark) Technical Grade, Technical Fine Grade and Superfine Grade (all being products of Clymax Molybdenum Corp.) Examples of tungsten disulfide that can be used are Micron Powder A and Micron Powder B produced by Nippon Junkatsuzai K. K. These solid lubricants are used in amounts ranging from 5 to 20 wt %, preferably from 10 to 15 wt %, of the product grease.

The grease of the present invention can be easily produced in the usual manner and a typical procedure is described below. First, specified amounts of the thickener and the solid lubricant are added to a specified amount of the base oil and the ingredients are mixed under agitation. They may be mixed with a common mixer such as a double-planetary mixer. The mixing is usually performed at a temperature between room temperature and 100° C. However, since the grease of the present invention is intended to be used under vacuum, the mixing operation is preferably performed at elevated temperatures of 70°–100° C. to achieve degassing. One to three hours suffices for the mixing purpose.

The resulting mixture is then treated to obtain a homogeneous mixture in the usual manner. This can be done by treatment with a microcolloid mill, a homogenizer or a roll mill. The treatment is usually performed at 50°–120° C. for 10–60 minutes. By this treatment, a gel structure is formed between the base oil and the thickener to provide the desired grease.

As will be demonstrated by the examples to be described below, the formulation comprising the three essential ingredients set forth above provides a lubricating grease that will wear less in a hot and high-vacuum atmosphere and that will exhibit high lubricating performance.

In the examples that follow, four samples of grease (Nos. 1–4) were prepared in accordance with the present invention and subjected to a comparative test for wear, load-bearing ability and endurance in a hot and high-vacuum atmosphere to see how they performed in a better way than conventional products (Comparative Sample Nos. 1–3) that are generally believed to exhibit good performance in a hot and high-vacuum atmosphere and which hence are extensively used in the art. The formulations of the respective samples are summarized in Table 1. The following examples are provided for the purpose of illustrating the present invention but are in no way to be taken as limiting.

Example 1

A base oil having 30 g of octadecyl-3-(3,5-di-t-butyl-4-hydroxyphenyl)propionate dissolved in 740 g of an alkyl substituted tetraphenylether (i.e., an oil having 1–4 substituents, two of which constitute a major component and each has 16 carbon atoms) was mixed with 160 g of a bentonite-based thickener and 100 g of molybdenum disulfide under agitation at 70° C. for 3 hours. The mixture was treated with a microcolloid mill to obtain 950 g of a grease (designated Sample No. 1 of the present invention as shown in Table 1).

This sample was spread as a layer 6 mm thick on the bottom of a stainless steel petri dish having a height of 17 mm and an inside diameter of of 88.1 mm. The petri dish was placed on a heater in a vacuum chamber and left to stand in vacuo ($9\times10^{-6}$ Torr) at 100° C. or 150° C.. At given intervals of time (24, 48 and 96 hours), the amount of wear of the grease was measured and the results are shown in Table 2.

The sample was also subjected to a load-bearing test with a block-on-ring tester in accordance with ASTM D 2714 and 3704, with a load of 20 pounds being applied per minute under specified test conditions (0.01 Torr, 150° C. and 100 rpm). The test specimen was prepared by applying a uniform coating of the grease onto the ring surface in an amount of ca. 0.1 g, and the load that caused an abnormal increase in torque was measured. The results are shown in Table 3.

The endurance of the sample was evaluated by measuring the time required for galling to occur when tested with a block-on-ring tester under the following conditions: 0.01 Torr, 150° C., 100 rpm and a load of 500 pounds. The results are shown in Table 4.

EXAMPLE 2

The procedure of Example 1 was repeated to prepare three additional grease samples of the present invention. In sample No. 2, the base oil was changed to an alkyl substituted tetraphenylether having 1–3 substituents, one of which constituted a major component and had 16 carbon atoms. In sample No. 3, the solid lubricant was changed to tungsten disulfide. Sample No. 4 was the same as sample No. 2 except that the solid lubricant was tungsten disulfide. As comparative samples, two commerical products were selected, one of which designated as Comparative Sample No. 1 was a grease based on a mineral oil, and other product designated as Comparative Sample No. 2 was the combination of this grease and a solid lubricant. These five samples were tested as in Example 1 and the results are summarized in Tables 2–4.

EXAMPLE 3

Comparative Sample No. 3 was prepared by coating molybdenum disulfide over the surface of a lubrication testing ring. The time required for galling to occur in this sample was measured as in Example 1, and the result is shown in Table 4.

As Table 2 shows, the grease samples of the present invention wore less than the commonly used greases based on a mineral oil and were effective in minimizing the fouling of the interior of the vacuum chamber. Further, they remained stable after the wear test, showing their high heat resistance and good operating characteristics in vacuo.

As Table 3 shows, the grease samples of the present invention exhibited better lubricating performance than the commercial greases. While the exact reason for this is not completely clear, one may well postulate that this can be ascribed to the fact that the base oil having high heat resistance and good operating characteristics in vacuum, the thickener, and the solid lubricant having a proper particle size and being added in an appropriate amount and additionally, the unique gel structure formed from these ingredients remained stable in a hot and high-vacuum atmosphere.

As Table 4 shows, the grease samples of the present invention exhibited consistent lubrication over a longer period than the solid lubricant coated on the metal surface. Lubrication with a grease allows for continuous feeding but the solid lubricant is incapable of consistent performance over a prolonged period since it will not restore its ability once it separates from the substrate or otherwise fails.

It is therefore clear that grease samples No. 1 to No. 4 exhibit better lubricating performance in a hot and high-vacuum environment over Comparative Samples No. 1 to No. 3.

TABLE 1

| | |
|---|---|
| Sample No. 1 | Grease composed of alkyl substituted tetraphenylether (i.e. oil having 1–4 substituents, two of which constitute a major component and each has 16 carbon atoms), octadecyl-3-(3,5-di-t-butyl-4-hydroxyphenyl)propionate, bentonite-based thickener, and molybdenum disulfide |
| Sample No. 2 | Grease composed of alkyl substituted tetraphenylether (i.e. oil having 1–3 substituents, one of which constitutes a major component and has 16 carbon atoms), octadecyl-3-(3,5-di-t-butyl-4-hydroxyphenyl)propionate, bentonite-based thickener, and molybdenum disulfide |
| Sample No. 3 | Grease composed of alkyl substituted tetraphenylether (i.e. oil having 1–4 substituents, two of which constitute a major component and each has 16 carbon atoms), octadecyl-3-(3,5-di-t-butyl-4-hydroxyphenyl)propionate, bentonite-based thickener, and tunsten disulfide |
| Sample No. 4 | Grease composed of alkyl substituted tetraphenylether (i.e. oil having 1–3 substituents, one of which constitutes a major component and has 16 carbon atoms), octadecyl-3-(3,5-di-t-butyl-4-hydroxyphenyl)propionate, bentonite-based thickener, and tungsten disulfide |
| Comparative Sample No. 1 | Grease composed of mineral oil and soap-based thickener |
| Comparative Sample No. 2 | Grease composed of mineral oil, soap-based thickener and molybdenum disulfide |
| Comparative Sample No. 3 | Molybdenum disulfide coated in a thickness of 8 μm on the metal surface |

TABLE 2

| | Cumulative wear (%) | | | | | |
|---|---|---|---|---|---|---|
| Test temperature (°C.) | 100 | | | 150 | | |
| Test time (hours) | 24 | 48 | 96 | 24 | 48 | 96 |
| Sample No. 1 | 0.1 | 0.2 | 0.4 | 3.8 | 7.0 | 11.0 |
| Sample No. 2 | 0.2 | 0.3 | 0.5 | 6.2 | 10.9 | 15.8 |
| Sample No. 3 | 0.1 | 0.3 | 0.4 | 3.8 | 7.1 | 11.8 |
| Sample No. 4 | 0.2 | 0.3 | 0.5 | 6.3 | 11.1 | 16.2 |
| Comparative Sample No. 1 | 2.8 | 3.8 | 5.7 | 11.1 | 18.1 | 23.0 |
| Comparative Sample No. 2 | 6.9 | 12.3 | 21.9 | 32.2 | 59.4 | 77.9 |

Test condition: Sample was spread to form a layer 6 mm thick on the bottom of a petri dish and left to stand in a vacuum chamber at $9 \times 10^{-6}$ Torr.

TABLE 3

| | Load-bearing ability (pound) |
|---|---|
| Sample No. 1 | 1020 |
| Sample No. 2 | 1000 |
| Sample No. 3 | 890 |
| Sample No. 4 | 890 |
| Comparative Sample No. 1 | 500 |
| Comparative Sample No. 2 | 860 |

Test condition: 150° C., 0.01 Torr, 100 rpm and at a load of 20 pounds/min.

TABLE 4

| | Endurance time (min.) |
|---|---|
| Sample No. 1 | 110 |
| Sample No. 2 | 110 |
| Sample No. 3 | 100 |
| Sample No. 4 | 110 |
| Comparative Sample No. 1 | 15 |
| Comparative Sample No. 2 | 50 |
| Comparative Sample No. 3 | 55 |

Test condition: 150° C., 0.01 Torr, 100 rpm and at a load of 500 pounds

According to the present invention, a lubricating grease that exhibits high lubricating performance in a hot and high-vacuum environment can be obtained by combining a base oil having high heat resistance and good operating characteristics in vacuum with a specified thickener and a specified solid lubricant. Further, as its structure suggests, the alkyl substituted tetraphenylether used as the base oil in the present invention has high radiation resistance. Consequently, the lubricating grease of the present invention is expected to lubricate satisfactorily gear wheels, bearings and other elements of the drive mechanism of machines to be used in a hot and high-vacuum environment.

What is claimed is:

1. A lubricating grease comprising the following ingredients:

(A) 55wt % to 90 wt % of a base oil composed of an alkyl substituted tetraphenylether having 1–4 substituents at least one of which has 6–20 carbon atoms;

(B) 5 wt % to 25 wt % of a bentonite-based thickener;

(C) 5 wt % to 20 wt % of at least one lubricant that is selected from the group consisting of molybdenum disulfide and tungsten disulfide and that has a particle size of 0.1 μm to 20 μm, and (D) up to 5 wt. % of an anti-oxidant.

* * * * *